US005579677A

United States Patent [19]

Chung

[11] Patent Number: 5,579,677

[45] Date of Patent: Dec. 3, 1996

[54] ACTUATOR OPERATING SIGNAL SENSOR

[75] Inventor: Dae S. Chung, Pusan, Rep. of Korea

[73] Assignee: Samsung Heavy Industries Co., Ltd., Seoul, Rep. of Korea

[21] Appl. No.: 497,668

[22] Filed: Jun. 30, 1995

[30] Foreign Application Priority Data

Oct. 29, 1994 [KR] Rep. of Korea ..... 94-28043

[51] Int. Cl.[6] ..... F15B 11/00

[52] U.S. Cl. ..... 91/508; 60/494

[58] Field of Search ..... 91/508; 60/420, 60/428, 494

[56] References Cited

U.S. PATENT DOCUMENTS 4,938,023 7/1990 Yoshino ..... 60/420 X 5,083,428 1/1992 Kubomoto et al. ..... 60/428 X 5,392,539 2/1995 Hirata et al. ..... 60/420 X

*Primary Examiner*—Hoang Nguyen

*Attorney, Agent, or Firm*—Kenyon & Kenyon

[57] ABSTRACT

A device for sensing actuator operating signal in a hydraulic system is disclosed. The device has auxiliary valves directly coupled to the directional control valves respectively, the internal lines of which auxiliary valves are opened or become orifices in accordance with positions of spools of their associated directional control valves. A fluid line extends from a hydraulic pump to a return tank after passing the auxiliary valves in a series. The device also has two elements for detecting fluid pressure at two given points along the fluid line. An additional orifice is formed in the hydraulic line between the auxiliary valves and the pressure detecting elements is provided in the hydraulic line before and after the additional orifice.

7 Claims, 2 Drawing Sheets

$P_S = P_1$
$P_D = 0$ $P_S = P_2\ (P_2 > P_1)$
$P_D = 0$ $P_S = P_3\ (P_3 > P_1)$
$P_D = 0$ $P_3 = P_5\ (P_5 \gg P_1, P_5 > P_2, P_5 > P_3)$
$P_D = P_6\ (P_6 > P_4)$

ACTUATOR OPERATING SIGNAL SENSOR

BACKGROUND OF THE INVENTION

1. Field of the Invention

The present invention relates in general to devices for sensing actuator operating signals in hydraulic systems and, more particularly, to a structural improvement in such an actuator operating signal sensor for hydraulic system having at least two actuators for not only sensing uni-actuator operating signals and multi-actuator operating signals, but also for discriminating between uni-actuator operating signals and multi-actuator operating signals.

2. Description of the Prior Art

Typically, the detection of fluid pressure in a directional control valve for an actuator of a hydraulic system is often used to determine whether the actuator's operation lever was handled to operate the actuator.

With reference to FIG. 1, there is shown a hydraulic system having a typical actuator operating signal sensor. As shown in the drawing, the hydraulic system includes two directional control valves 103*a* and 103*b* connected to their associated actuators 101*a* and 101*b*. Two auxiliary valves 105*a* and 105*b* are directly coupled to the control valves 103*a* and 103*b* respectively. The internal lines of the auxiliary valves 105*a* and 105*b* are opened or closed in accordance with positions of spools for their associated control valves 103*a* and 103*b*. A fluid line 107 extending from a hydraulic pump P to a return tank T passes the auxiliary valves 105*a* and 105*b* in a series. The internal lines of the auxiliary valves 105*a* and 105*b* are opened when the spools of the valves 103*a* and 103*b* are in their neutral positions, but opened when the spools of valves 103*a* and 103*b* are moved.

In order to sense operating signals from actuators 101*a* and 101*b* in the above hydraulic system, or to determine whether the operation levers for the actuators 101*a* and 101*b* were handled to operate the actuators, the pressures PA and PB at given points of the line 107, or at point A (between the pump P and the first auxiliary valve 105*a*) and at point B (between the first and second auxiliary valves 105*a* and 105*b*) are detected. That is, when the first actuator 101*a* is in operation by handling its associated operating lever, the pressure PA at point A will increase as the internal lines of the first auxiliary valve 105*a* are directly connected to the first control valve 103*a* are closed due to movement of the spool of the first control valve 103*a*. In the same manner, when the second actuator 101*b* is in operation by handling its associated operating lever, the pressure PB at point B will be increased as the internal lines of the second auxiliary valve 105*b* directly connected to the second control valve 103*b* are closed due to movement of the spool of the second control valve 103*b*.

The pressures PA and PB at points A and B in accordance with operational states of the actuators 101*a* and 101*b* are given in the following Table 1. In the following description and in Table 1 for the pressures PA and PB, the value "0" is a relatively lower value meaning that all of the internal lines of the auxiliary valves 105*a* and 105*b* are opened, while the value "1" is a relatively higher value meaning that all of the internal lines of the auxiliary valves 105*a* and 105*b* are closed.

TABLE 1

| | | |
|---|---|---|
| 1 | neutral position of 101a, 101b | PA = 0, PB = 0 |
| 2 | exclusive operation of 101a | PA = 1, PB = 0 |

TABLE 1-continued

| | | |
|---|---|---|
| 3 | exclusive operation of 101b | PA = 1, PB = 1 |
| 4 | operation of 101a, 101b | PA = 1, PB = 1 |

1) In the case of neutral positions of the operating levers for both actuators 101*a* and 101*b* or non-operation of both actuators:

The internal lines of both auxiliary valves 105*a* and 105*b* are opened so that both pressures PA and PB have the value "0".

2) In the case of exclusive operation of the first actuator 101*a:*

The internal lines of the first auxiliary valve 105*a* are closed while the internal lines of the second auxiliary valve 105*b* are opened so that the pressures PA and PB have the value "1" and "0" respectively.

3) In the case of exclusive operation of the second actuator 101*b:*

The internal lines of the first auxiliary valve 105*a* are opened while the internal lines of the second auxiliary valve 105*b* are closed. However, both pressures PA and PB have the value "1" as closing of the Internal lines of the second valve 105*b* exerts influence upon both points A and B of the line 107.

4) In the case of simultaneous operation of both actuators 101*a* and 101*b:*

The internal lines of the both auxiliary valves 105*a* and 105*b* are closed so that both pressures PA and PB have the value "1".

In the above description for the hydraulic system having the typical actuator operating signal sensor, it is noted that the device can sense both the case of at least one actuator operating and the case of no actuators operatins, however, the device can not discriminate the case of exclusive operation of an actuator from the case of simultaneous operation of two actuators. That is, the typical device can not discriminate the case of exclusive operation of, for example, the second actuator 101*b* from the case of simultaneous operation of the two actuators 101*a* and 101*b* as both pressures PA and PB in the above two cases alike have the value "1" as shown in Table 1.

SUMMARY OF THE INVENTION

It is, therefore, an object of the present invention to provide a device for sensing actuator operating signals in which the above problem can be overcome and which is used in a hydraulic system with at least two actuators and effectively discriminates exclusive operation of an actuator from simultaneous operation of the actuators.

In order to accomplish the above object, the present invention provides a device for sensing an actuator operating signal in a hydraulic system having at least two actuators along with directional control valves controlling the fluid flow and the flowing direction of pressurized fluid for their associated actuators, wherein the improvement comprises: auxiliary valves directly coupled to the directional control valves respectively, the internal lines of the auxiliary valves being opened or becoming orifices in accordance with positions of spools of their associated directional control valves; a fluid line extending from a hydraulic pump to a return tank after passing the auxiliary valves in a series; and means for detecting fluid pressure at one or more given point of the fluid line.

In accordance with a preferred embodiment of this invention, the internal lines of one of the two auxiliary valves become a first orifice when the spool of an associated directional control valve is in the neutral position, but are opened when the spool of the associated directional control valve is moved, while the internal lines of the other auxiliary valve are opened when the spool of an associated directional control valve is in the neutral position, but become a second orifice when the spool of the associated directional control valve is moved.

In accordance with another embodiment of this invention, a third orifice is formed in the hydraulic line between the auxiliary valves and the pressure detecting means is provided in the hydraulic line before and after the third orifice.

BRIEF DESCRIPTION OF THE DRAWINGS

The above and other objects, features and other advantages of the present invention will be more clearly understood from the following detailed description taken in conjunction with the accompanying drawings, in which:

FIGS. 3A to 3D are schematic circuit diagrams of the system of FIG. 2, showing variation of detected pressures in accordance with operational states of two actuators of the system, in which:

FIG. 3A shows the case of nor actuators being operated;

FIG. 3B shows the case of operating of one of the actuators;

FIG. 3C shows the case of operating the other actuator; and

FIG. 3D shows the case of simultaneous operation of both actuators.

DESCRIPTION OF THE PREFERRED EMBODIMENTS

Figure 1:
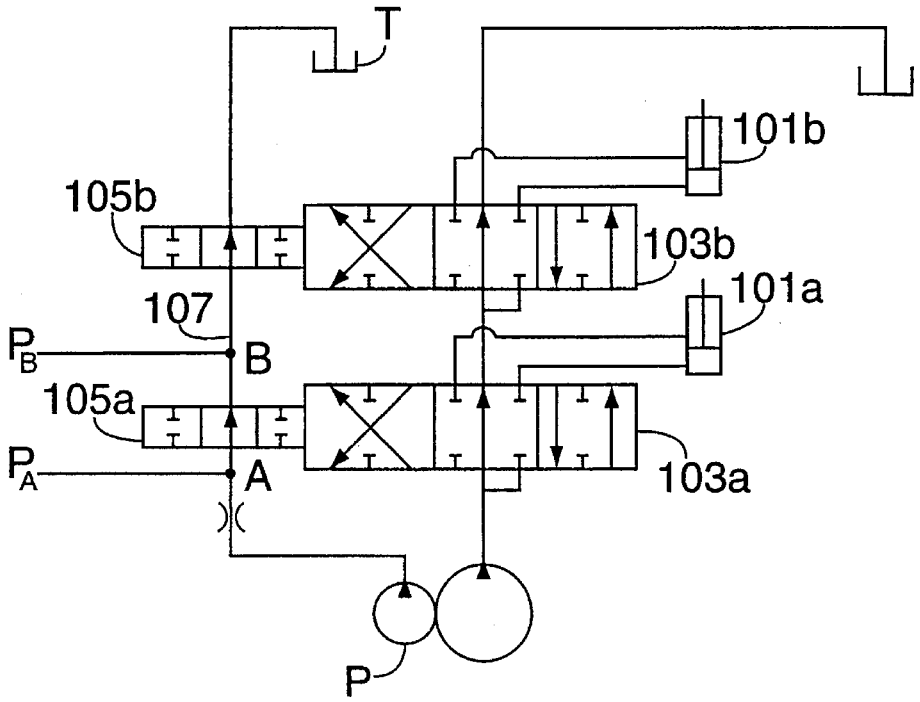
FIG. 1 PRIOR ART
FIG. 1 is a circuit diagram of a hydraulic system for a typical actuator operating signal sensor.
Figure 2:
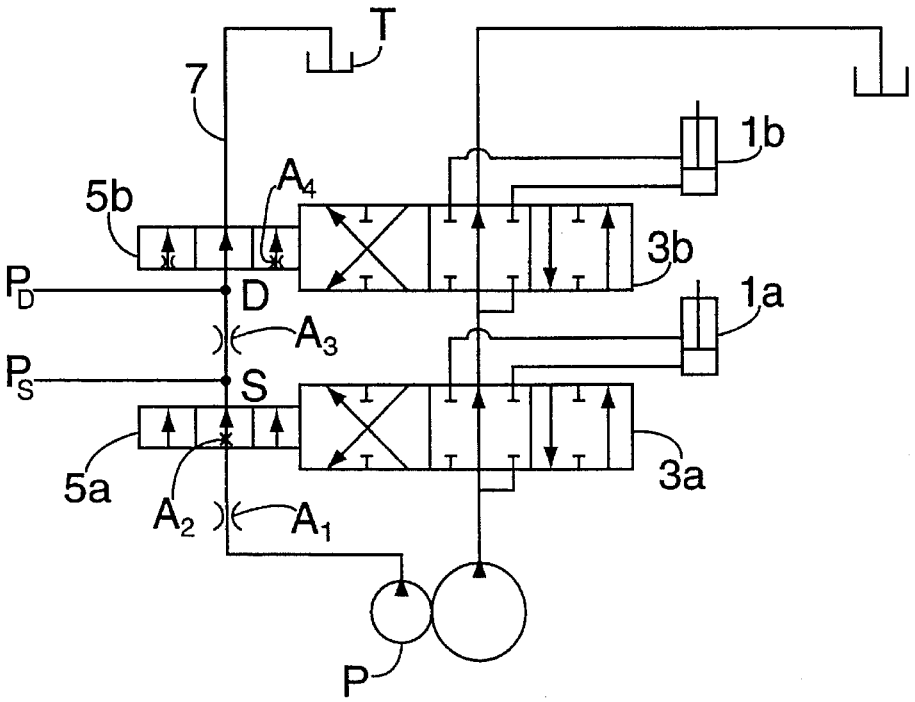
FIG. 2 is a circuit diagram of a hydraulic system for an actuator operating signal sensor in accordance with a preferred embodiment of the present invention.

FIG. 2 is a circuit diagram of a hydraulic system with an actuator operation signal sensing device in accordance with a preferred embodiment of this invention.

As shown in the drawing, the hydraulic system of this invention includes two directional control valves 3*a* and 3*b* connected to their associated actuators 1*a* and 1*b*. Two auxiliary valves 5*a* and 5*b* are directly coupled to control valves 3*a* and 3*b* respectively. The internal lines of auxiliary valves 5*a* and 5*b* are opened or become orifices in accordance with the positions of the spools for their associated control valves 3*a* and 3*b*. A fluid line 7 extending from a hydraulic pump P to a return tank T passes the auxiliary valves 5*a* and 5*b* in a series. The internal lines of the two auxiliary valves 5*a* and 5*b* are designed in such a manner that the internal lines of the first valve 5*a* become a first orifice A2 when the spool of its associated first control valve 3*a* is in the neutral position, but are opened when the spool of the valve 3*a* is moved, and that the internal lines of the second valve 5*b* are opened when the spool of its associated second control valve 3*b* is in the neutral position, but become a second orifice A4 when the spool of the valve 3*b* is moved. In the above hydraulic system, the pump P, the auxiliary valves 5*a* and 5*b* and the return tank T are arranged in series through the fluid line 7 in order of the pump P, the first valve 5*a*, the second valve 5*b* and the tank T.

Additionally, a third orifice A3 is formed in the line 7 between the first and second auxiliary valves 5*a* and 5*b*. In order to detect fluid pressures PS and PD at points "S" and "D" before and after the third orifice A3, two pressure detecting means 9*a* and 9*b* are provided at the two points S and D respectively.

In the above system, it is preferred to form a fourth orifice A1 in the line 7 between the pump P and the first valve 5*a*. When the system has the orifice A1, the relative pressure difference between the case of neutral positions of the spools of the control valves and the case of movement of that spools or between the case of operation of no actuator and the case of operation of the actuators and will be increased.

Hereinbelow, operational effect of the above device will be described in detail by operational states of the two actuators 1*a* and 1*b* and with reference to Table 2 and to the accompanying drawings, FIGS. 3A to 3D.

TABLE 2

| | | |
|---|---|---|
| 1 | neutral position of 1a, 1b | PS = P1, PD = 0 |
| 2 | exclusive operation of 1a | PS = P2, PD = 0 |
| 3 | exclusive operation of 1b | PS = P3, PD = P4 |
| 4 | operation of 1a, 1b | PS = P5, PD = P6 |

The pressures P1, P2, P3, P4, P5 and P6 in the Table 2 have the following inequalities:

$$P1<P2;\ P1<P3;\ P1<<P4;\ P2<P5;\ P3<P5;\ \text{and}\ P4<P6$$

Figure 3A:
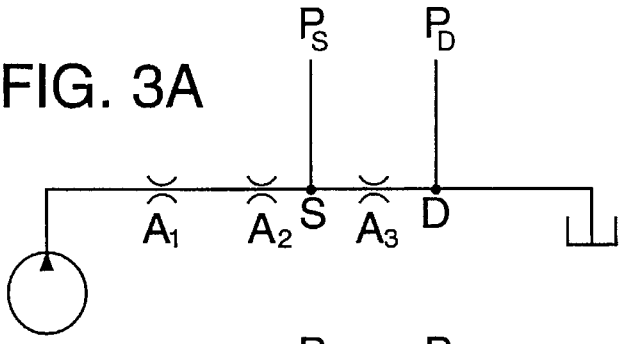
Figure 3B:
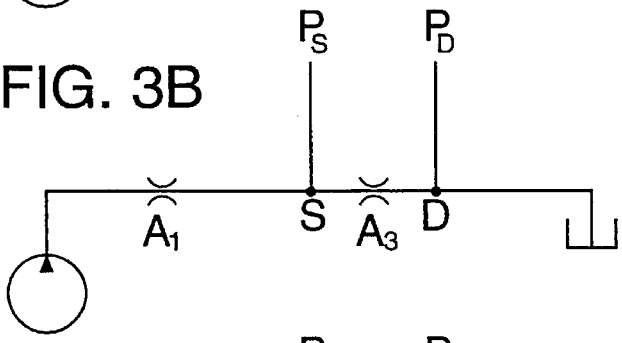
Figure 3C:
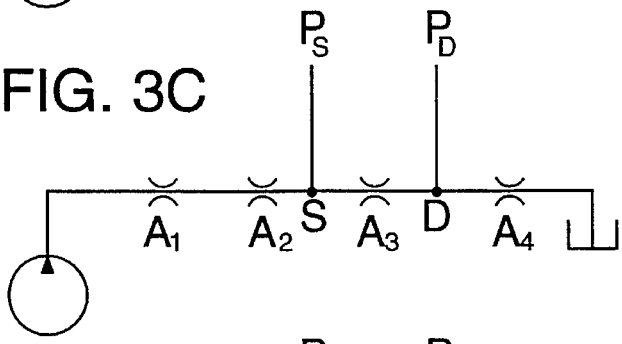
Figure 3D:
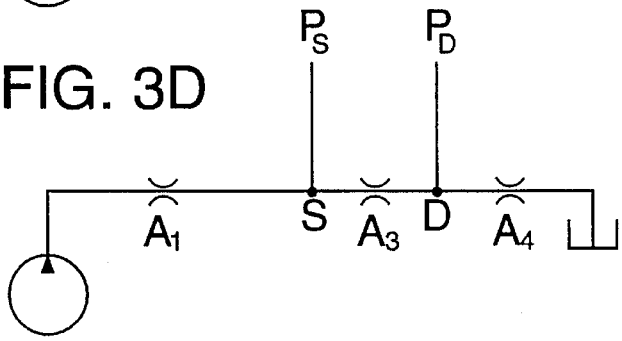

1) In the case of neutral positions of the operation levers for both actuators 1*a* and 1*b* or of operation of no actuator:

The internal lines of the first auxiliary valve 5*a* become the orifice A2 so that the pressure PS at the point "S" is equal to a given pressure P1 preset by the orifice A3, and, at the same time, the internal lines of the second auxiliary valve 5*b* are opened so that the pressure PD at the point "D" has the value "0" (see FIG. 3A).

2) In the case of exclusive operation of the first actuator 1*a:*

The internal lines of the first and second auxiliary valves 5*a* and 5*b* are opened so that the pressure PS is equal to a given pressure P2 and the pressure PD has the value "0".

In this case, the pressure P2 is somewhat higher than the pressure P1 of the above case (1) as the fluid flow in the line 7 before the orifice A3 is increased due to the internal lines of the first valve 5*a* (see FIG. 3B) opening.

3) In the case of exclusive operation of the second actuator 1*b:*

The internal lines of the first and second auxiliary valves 5*a* and 5*b* become orifices A2 and A4 respectively so that the pressure PS is equal to a given pressure P3 preset by the orifices A3, A4 and A2 and the pressure PD is equal to a given pressure P4 preset by the orifices A2 and A4. In this case, the pressure PS is somewhat higher than the pressure P1 as the system of this case (3) additionally has the orifice A4 in comparison with the case (1). However, the difference between the pressure PS and the pressure P2 is not confirmed. On the other hand, the pressure PD has a given pressure P4 as the system of this case additionally has the orifice A4 in comparison with the cases (1) and (2) (see FIG. 3C).

4) In the case of simultaneous operation of both actuators 1*a* and 1*b:*

The internal lines of the first auxiliary valve 5*a* are opened while the internal lines of the second auxiliary valve 5*b* become the orifice A4 so that the pressure PS is equal to a given pressure P5 preset by the orifices A3 and A4 and the pressure PD is equal to a given pressure P6 preset by the orifice A4. In this case, the pressure PS (=P5) is relatively higher than either of the pressures P1, P2 and P3 due to increase of the fluid flow in the line 7 before the orifice A3 as the system of this case (4) has the orifices A3 and A4 and as the internal lines of the first valve 5*a* are opened. Even though the orifice A4 acts in this case (4) in the same manner as described for the case (3), the fluid flow before the orifice A3 is increased due to the internal lines of the first valve 5*a* opening. The pressure P6 is, therefore, relatively higher than the pressure P4 (see FIG. 3D).

In the above description for the hydraulic system having the actuator operation signal sensing device of this invention, it is noted that device instantly senses the case of operation of at least one actuator when the pressure PS is equal to either of the pressures P2, P3 and P5 which are higher than the given pressure P1. The device also senses the case of simultaneous operation of two actuators 1*a* and 1*b* when the pressure PD is equal to the pressure P6 which is higher than the given pressure P4. Otherwise stated, the case of pressure PS increased and pressure PD not increased means the case of exclusive operation of an actuator. The case of pressures PS and PD increasing means the case of simultaneous operation of the actuators. In addition, the case where neither pressure PS, PD is increasing means there is no actuator operating.

As described above, the present invention provides an actuator operating signal sensor for a hydraulic system having at least two actuators, which device not only senses handling signals for actuators but also discriminates between the exclusive operation of an actuator and simultaneous operation of the actuators. In this regard, the device of this invention can be effectively used as a straight advancing signal sensor for travelling construction vehicle needing to determine whether the operation levers for left and right travelling motors were simultaneously handled, and as an auto-deceleration signal sensor needing to determine whether the operation levers for all of actuators are in their neutral positions.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. For example, the device of this invention may be used in a hydraulic system with three or more actuators besides the above-described hydraulic system with two actuators.

What is claimed:

1. A device for sensing an actuator operating signal in a hydraulic system having at least two actuators along with directional control valves controlling the fluid flow and flowing direction of pressurized fluid for their associated actuators, wherein the improvement comprises:

auxiliary valves directly coupled to said directional control valves respectively, the internal lines of said auxiliary valves being opened or becoming orifices in accordance with positions of spools of their associated directional control valves;

a fluid line extending from a hydraulic pump to a return tank after passing said auxiliary valves in series; and means for detecting fluid pressure at one or more given point of said fluid line.

2. The device according to claim 1, wherein the internal lines of one of said two auxiliary valves become a first orifice when the spool of an associated directional control valve is in the neutral position, but are opened when the spool of the associated directional control valve is moved, while the internal lines of the other auxiliary valve are opened when the spool of an associated directional control valve is in the neutral position, but become a second orifice when the spool of the associated directional control valve is moved.

3. The device according to claim 2, wherein said hydraulic pump, said auxiliary valves and said return tank are arranged in a series through said fluid line in order of the pump, the one auxiliary valve, the other auxiliary valve and the tank.

4. The device according to claim 2, wherein a third orifice is formed in said hydraulic line between the auxiliary valves and said pressure detecting means is provided in the hydraulic line before and after the third orifice.

5. The device according to claim 3, wherein a third orifice is formed in said hydraulic line between the auxiliary valves and said pressure detecting means is provided in the hydraulic line before and after the third orifice.

6. The device according to claim 2, wherein a fourth orifice is formed in the hydraulic line between said hydraulic pump and the one auxiliary valve.

7. The device according to claim 3, wherein a fourth orifice is formed in the hydraulic line between said hydraulic pump and the one auxiliary valve.

* * * * *